United States Patent [19]

Brailean

[11] Patent Number: 4,749,198

[45] Date of Patent: Jun. 7, 1988

[54] TRACKABLE ARROW

[76] Inventor: Larry D. Brailean, 6423 - 1st Avenue N., Regina, Canada, S4T 7C2

[21] Appl. No.: 86,827

[22] Filed: Feb. 12, 1987

[30] Foreign Application Priority Data

Oct. 3, 1986 [CA] Canada ..... 519777

[51] Int. Cl.[4] ..... F41B 5/02; G08B 21/00

[52] U.S. Cl. ..... 273/416; 273/213; 340/636; 455/98; 455/116; 455/127

[58] Field of Search ..... 273/416–423, 273/213; 340/636, 539; 455/98, 115, 116, 127

[56] References Cited

U.S. PATENT DOCUMENTS

| | | | |
|---|---|---|---|
| 3,782,730 | 1/1974 | Horchler | 273/213 |
| 3,790,948 | 2/1974 | Ratkovich | 273/416 X |
| 4,216,648 | 8/1980 | Maire | 340/636 X |
| 4,232,308 | 11/1980 | Lee et al. | 340/636 X |
| 4,340,930 | 7/1982 | Carissimi | 273/416 X |
| 4,421,319 | 12/1983 | Murphy | 273/213 X |
| 4,471,492 | 9/1984 | Mann et al. | 340/636 X |
| 4,675,683 | 6/1987 | Robinson et al. | 273/416 X |
| 4,706,689 | 11/1987 | Man | 340/539 |

*Primary Examiner*—Paul E. Shapiro

*Attorney, Agent, or Firm*—Michael M. Sakovich

[57] ABSTRACT

An arrow that accepts standard target or hunting tips includes a radio signalling transmitter which emits a carrier signal that is receivable by a directional receiver for tracking and locating the arrow when released from a bow. The transmitter includes a carrier interrupting circuit operating at a rate that is inversely proportional to battery voltage which permits dynamically testing the battery prior to releasing the arrow. This provides reliable operation of the transmitter by insuring an adequate minimum charge in the battery. An electrical switch embodying the arrow tip as an actuator permits selectively connecting or disconnecting the battery from the transmitter to conserve the battery charge.

18 Claims, 3 Drawing Sheets

TRACKABLE ARROW

FIELD OF THE INVENTION

This invention relates to an arrow and more particularly to a hunting or target arrow that includes a homing signal transmitter which facilitates locating the arrow.

BACKGROUND OF THE INVENTION

Hunting small and large game by means of a bow and arrow is a sports activity that calls for considerable skill and precision in bow handling. Since effective killing ranges are less than those experienced using firearms, the successful bow hunter must also be adept at stalking wildlife. Often, this represents a substantial portion of the time that a hunter is able to devote to the sport. It becomes imperative, therefore, for a hunter to seize each opportunity to shoot at available game in order to be assured of success in the field.

Arrows are relatively expensive items which are not necessarily seen by the average hunter as being expendable. Accordingly, it is expected that even though an arrow may have missed its mark, it may be subsequently retrieved for further use. This may not always be the case, however, especially where underbrush is thick. Under these circumstances, the hunter faces the dilemma of waiting for a surer shot, which may not occur, or to shoot at game whenever an opportunity permits regardless of the loss in arrows that this entails.

A serious problem that confronts the hunting archer is the loss of game that, even though mortally wounded, may still manage to make good its escape. This is probably a relatively common experience since the lethal aspects of an arrow are derived from its ability to inflict hemorrhaging in a game animal which is capable of traversing considerable distances before succumbing to blood loss. Not only is the arrow lost under these circumstances, but a greater loss is incurred by game that is killed without providing any benefit to the hunter.

The aforenoted problems of the prior art have been recognized and an attempt has been made to overcome such problems through the provision of a hunting arrow having radio transmitter locating means associated therewith as disclosed in U.S. Pat. No. 3,790,948 Ratkovich which issued Feb. 5, 1974. Whereas the Ratkovich hunting arrow overcomes the basic problem of locating an arrow lost in thick underbrush and in tracking wounded game, there are certain problems that remain unsolved. For example, the Ratkovich arrow does not provide means for testing the battery of its transmitter. Thus, an arrow may be lost due to insufficient signal strength from the transmitter occasioned by a weak battery. This problem is further aggravated by the fact that Ratkovich does not provide a reliable power switch to disable the transmitter circuit. Unless fresh batteries are used, the operation of the Ratkovich transmitter becomes uncertain.

Another expected difficulty with the Ratkovich arrow relates to the special arrowhead that is required to house the transmitter. Since this arrowhead is not a standard in the industry, it is expected that replacements would be expensive. Should a Ratkovich arrowhead be damaged, it cannot be replaced with an industry standard thereby limiting the Ratkovich arrow when afield. Moreover, the Ratkovich arrow is applicable for hunting only and also requires a special arrow shaft for mounting the arrowhead.

SUMMARY OF THE INVENTION

A principal objective of the present invention is to provide a hunting or target arrow having radio signalling means from which interrupted carrier signals are detectable by a directional radio receiver to enable tracking and locating the arrow.

Another provision of the invention is an arrow that includes, as a portion of its structure, a radiating element of an antenna.

Yet another provision of the invention is an arrow with switch means for selectively energizing and deenergizing the radio signalling means.

Still another provision of the invention is an arrow having a dynamic battery testing facility.

The problems associated with the prior art may be substantially overcome and the foregoing provisions achieved by recourse to the invention which is a trackable arrow comprising, a shaft having side walls defining a hollow chamber, an electrically conductive member coextensive with the shaft and adapted to function as a radiating element of an antenna, radio signalling means including variable rate carrier interrupt means being rate responsive to a source of operating voltage, and coupling means positioned between an output of the signalling means and the conductive member to effect a transfer of radio signal energy therebetween, whereby interrupted carrier signals radiated from the conductive member are detectable by a directional radio receiver to effect a test of the energy source prior to releasing the arrow from a bow and subsequently tracking and locating the released arrow.

DESCRIPTION OF THE DRAWINGS

The invention will now be more particularly described with reference to embodiments thereof shown, by way of example, in the accompanying drawings in which.

DESCRIPTION OF THE ILLUSTRATED EMBODIMENTS

Figure 2:
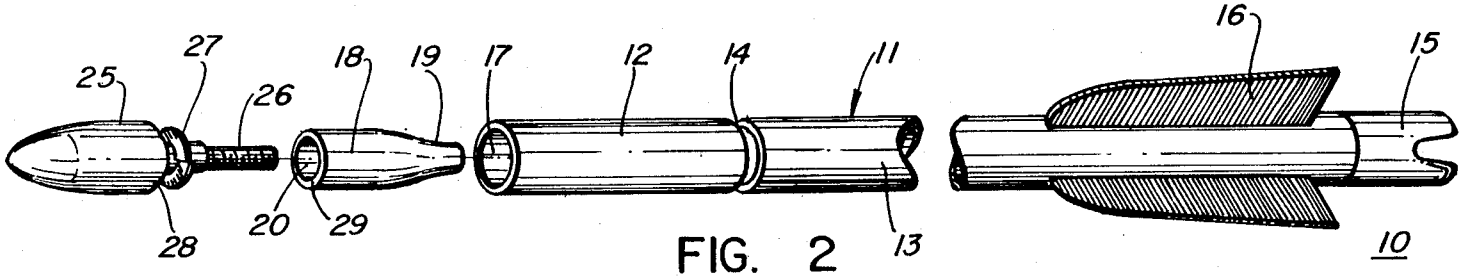
FIG. 2 is a partial, exploded perspective view showing the structural elements of an arrow in accordance with the present invention.

The mechanical elements of a trackable arrow 10 are shown in a partial, exploded perspective view in FIG. 2. These elements comprise an Easton type 2216 cylindrical aluminum arrow shaft 11 having a leading portion 12 and a trailing portion 13 separated at a cut 14 which is open to provide access to the respective interiors of both portions.

It will be observed that a trailing butt end of the portion 13 is closed by a nock 15 and that adjacent the nock conventional fletching 16 is uniformly disposed about the external periphery of the shaft 11.

An open tip end 17 of the portion 12 permits the insertion of an arrowhead tip insert 18 that is held in place within the hollow interior of the portion 12 by way of an interference fit with the side walls thereof. The insert 18 is a standard item that has been slightly modified to facilitate its use in the present invention. In this regard, a trailing portion 19 has been shortened so that the insert 18 has an overall length not exceeding 14 mm. This aspect of the invention will be subsequently described in greater detail.

The function of the insert 18 is to provide convenient means for attaching standard arrowhead tips. In this regard, the insert is provided with a threaded axial bore 20.

Figure 4:
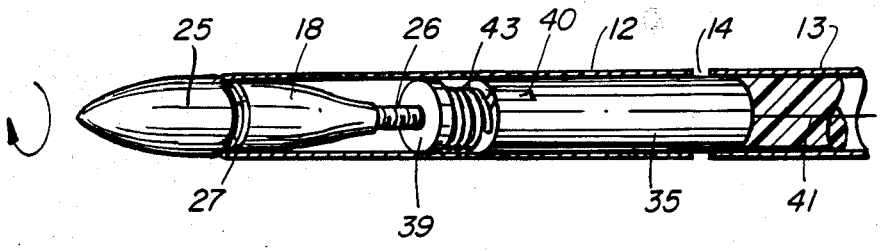
FIG. 4 is a partial perspective view of the arrow of FIG. 3 shown in an assembled state.
Figure 5:
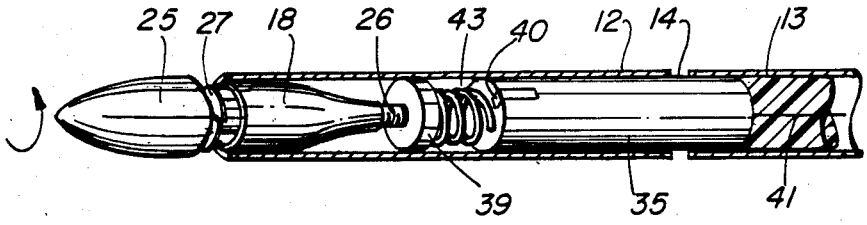
FIG. 5 is another view of the assembled arrow.

FIGS. 2, 4 and 5 illustrate the manner of attaching an arrowhead, shown in these figures as a target tip 25. Securing the tip 25 to the arrow 10 is done simply by inserting a correspondingly threaded trailing axial extension 26 into the bore 20 and screwing the tip into the insert until a compression washer 27 is sandwiched between a shoulder 28 of the tip 25 and a corresponding annular abutting portion 29 of the insert 18. When compressed, the washer 27 exerts a restoring force between the insert 18 and the tip 25 to prevent the tip from accidentally loosening in the normal course of handling.

It will be understood that the insert 18 may be oriented with the portion 13 to assure uniform plane alignment of the blades of a screw-in broad head arrow tip (not shown) relative the fletching 16. This aids arrow flight stability.

Figure 1:
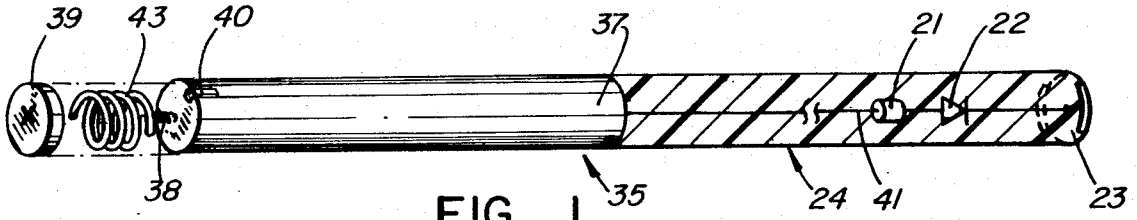
FIG. 1 is an exploded perspective view showing an electrical contact relationship between a transmitter cartridge and a battery according to the present invention.

The purpose of the portions 12 and 13 will next be described having regard to FIGS. 1, and 3–6. FIG. 1 illustrates a transmitter insert 35 which incorporates a radio signalling circuit 36 having variable rate carrier interrupt means, as will be subsequently described. The circuit 36 is preferably potted using a known injectable foam that sets to a resilient adhesive. Liquid silicone rubber compounds may also be used as ready substitutes since they have similar properties. In any event, it is desirable to use a light weight resilient potting compound such as TOUCH'N FLOW* by Dow Chemical to prevent component failure resulting from high stresses that are set up when the arrow hits a target.

*Trade Mark

Figure 6:
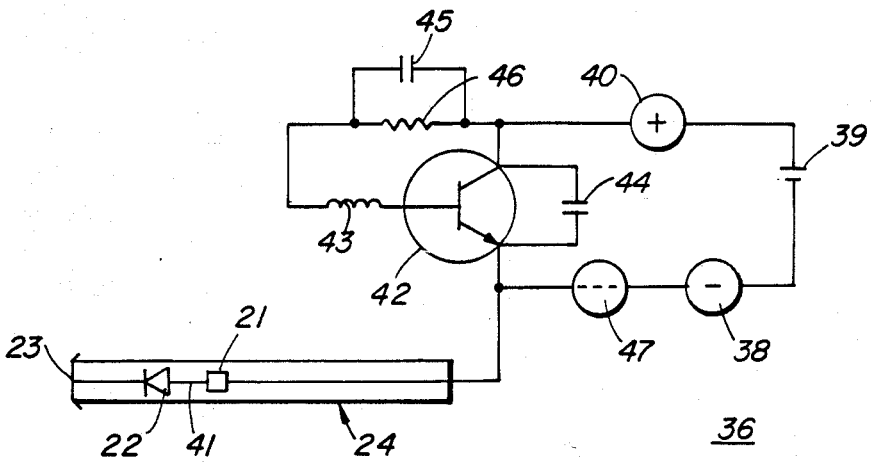
FIG. 6 is a schematic diagram of a solid state pulsed transmitter used in the transmitter cartridge of FIG. 1.

In the embodiment herein described, the circuit 36 is assembled on a printed circuit board and is potted, as hereinabove described, in a 70 mm length of F45 GRAFLEX* arrow stock 37 (FIG. 1). A coil spring electrical contact 38 extends axially out of one end of the insert 35 and provides contact with the negative terminal of a battery 39. Contact with the positive terminal of the battery is made by way of a brass spring tab shown as an electrical contact 40 which makes contact with the side wall of the portion 12 and thereby establishes contact with the positive terminal of the battery 39. Extending coaxially from the end of the insert 35 opposite the contact end, is an insulated steel wire that comprises the transmitter's antenna 41. In the event that the shaft 11 is either bitten or broken off, antenna integrity is maintained by fabricating the antenna 41 from insulated #30 gauge steel wire of 150 mm length which is disposed coaxially within the portion 13. FIG. 6 shows one end of the antenna 41 connected to the emitter of an NPN transistor 42 type 2N4123. The other end of the antenna 41 passes through an RF bead 21 and is connected to the cathode of a diode 22 having its anode connected to a brass spring cap 23. Moulding the antenna 41, the RF bead 21, diode 22 and cap 23 in TOUCH'N FLOW* forms an assembly 24 that is insertable in the portion 13 and provides the coaxial alignment with the shaft 11. Moreover, this arrangement maintains uniform transmission characteristics of the circuit 36 and permits the arrow to float so that it may be retrieved from water.

*Trade Mark

The insert 35 is mounted within the shaft 11 by inserting the contact end of the insert into the portion 12 at the cut 14. Similarly, the assembly 24 is inserted into the portion 13 at the cut 14 ensuring that the cap 23 makes electrical contact with the inner periphery of the conductive aluminum side walls of the portion 13.

Several arrows 10 may be carried together without concern that the respective battery 39 of any arrow may be inadvertently discharged by a short circuit between the tip 25 and the portion 13. It will be seen that the diode 22 is poled such that any short circuit current is kept small because it must conduct against the high back resistance of the diode. This arrangement also permits the ends of the portions 12 and 13 at the cut 14 to be drawn into electrical contact without shorting the output terminals of the battery 39.

Should the battery 39 be replaced with a rechargeable type, the replacement battery may be recharged without removal from the arrow 10 simply by connecting clip leads from a charging source (not shown) to the tip 25 and the portion 13. A charging current would then encounter only the low forward resistance of the diode 22.

Figure 3:
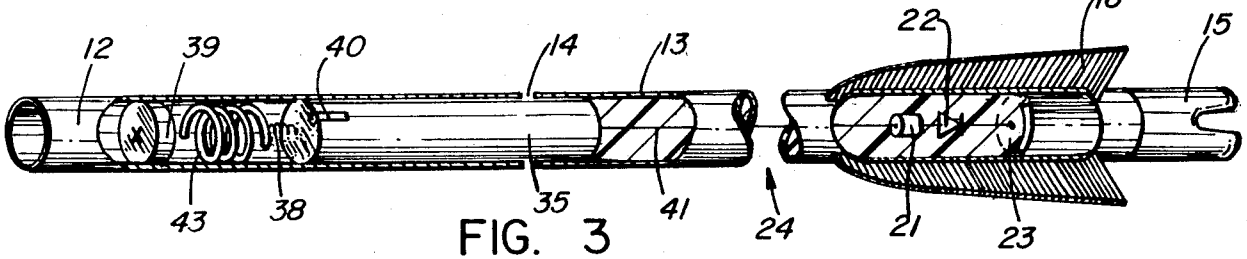
FIG. 3 is a partial, exploded perspective view of the arrow of FIG. 2 showing the location of the transmitter cartridge of FIG. 1.

Final assembly of the arrow 10 requires inserting an insulated coil spring 43 into the end 17 followed by the battery 39 as illustrated in FIG. 3. This is then followed by inserting the insert 18 unless such insert was previously in place. In this event, the order of assembly would be changed by adding the battery 39, followed by the spring 43, to the portion 12 prior to inserting the contact end of the insert 35.

Switch means to either enable or disable the circuit 36 are provided via the spring 43 in combination with the insert 18 and the tip 25. As may be best seen in FIG. 4, the switch comprising these elements is closed to energize the circuit 36 by rotating the tip 25 such that its extension 26 extends through the portion 19 and forces the negative terminal of the battery 39 against the resilient spring 43 so that the negative terminal of the battery makes a connection with the contact 38. Conversely, the switch contact is broken and the circuit 36 is disabled by rotating the tip 25 in an opposite direction which causes longitudinal withdrawal of the portion 19. The coil spring 43 is thus permitted to expand and to force the negative terminal of the battery 39 out of contact with the contact 38. FIG. 5 illustrates the longitudinal withdrawal of the tip 25 and the expanded spring 43.

The transmitter 36 is shown in FIG. 6 to comprise an oscillator employing the transistor 42 which receives its operating energy from the battery 39. The circuit can be designed to operate over a wide frequency range although the range of 130–174 MHz is preferred. The carrier frequency is fixed by means of a tank circuit that comprises an inductor 43 and a capacitor 44 of small electrical value (15pf) that is connected between the emitter and collector of the transistor 42. The inductor 43, however, is connected between the base and collector of the transistor.

The carrier signal generated by the transistor 42 is interrupted at a variable rate by means of an RC circuit that is serially connected between the inductor 43 and the collector of the transistor 42. It will be observed in FIG. 6 that the RC circuit comprises a parallel combination of a capacitor 45 having an electrical value of 22 Mf and a resistor 46 having a resistive value of 39 K ohms.

Figure 7:
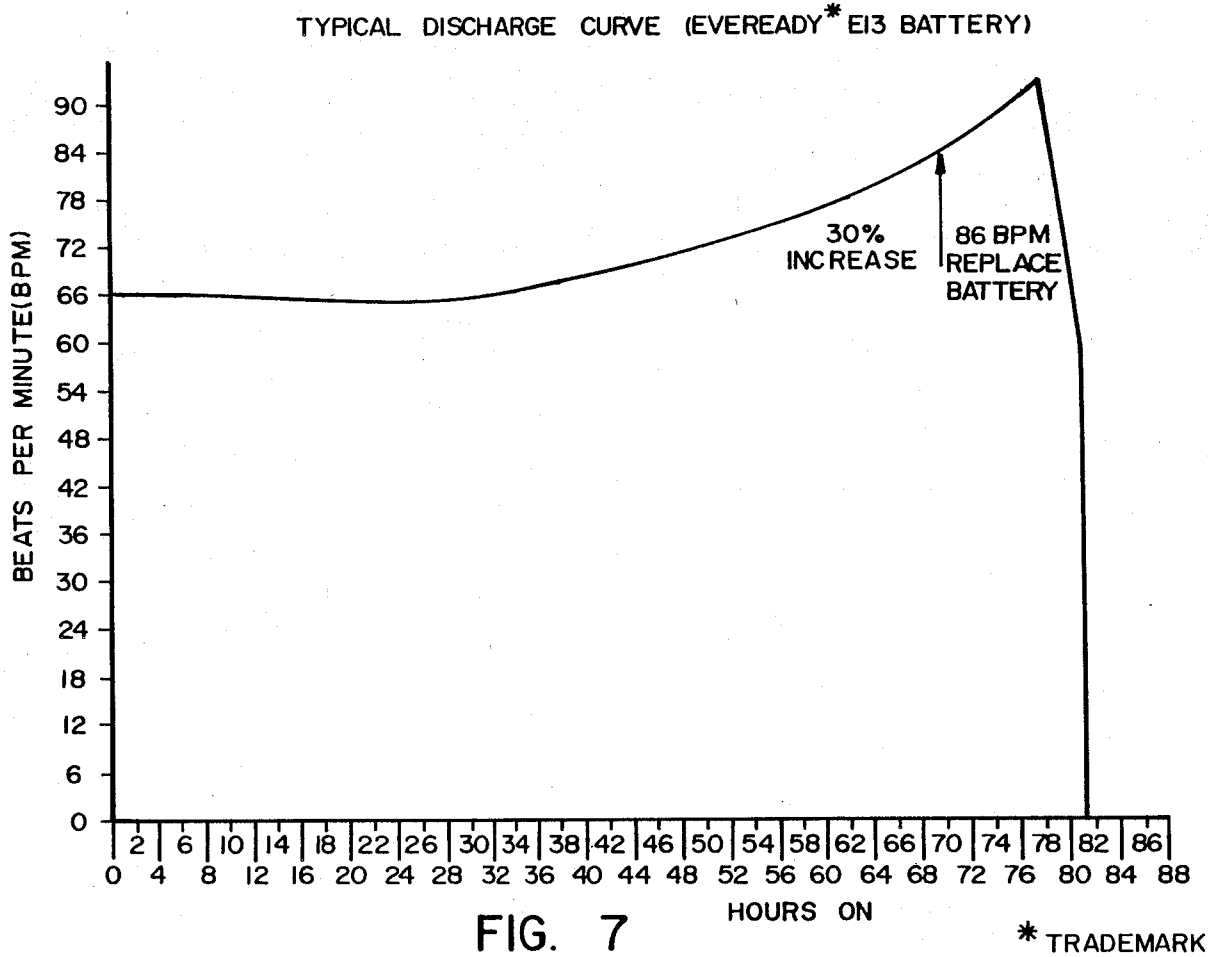
FIG. 7 is a line graph showing the pulse rate of the transmitter in FIG. 6 relative hours of battery use.

The carrier interrupt circuit is rate responsive to the voltage of the battery 39 such that for a fresh battery the carrier is interrupted at a rate of 66 pulses per minute (FIG. 7). For a used battery, after approximately seventy hours of use, the pulse rate increases to about 84 pulses per minute. At this time, it is estimated that there are approximately ten useful hours of battery time left and it is recommended that the battery 39 be replaced. Preferably, the battery should be replaced when the pulse rate increases by 30% of a fresh battery rate.

The interrupted carrier output signal may be received by a simple Public Service band receiver thatis readily available. According to the Ratkovich patent, a general type of receiver that could be usedwith the receiver of the present inventionis shown and described in U.S. Pat. No. 3,336,530 Sloane et al.

Since the carrier interrupt circuit is responsive to the voltage of the battery 39, the interrupted carrier signal received by the receiver may be used as a convenient means to determine the relative quantity of charge remaining in the battery and when the battery should be replaced to ensure successfully locating the arrow. As previously noted, when the interrupted carrier signal has a 30% higher repetition rate, the battery should be replaced and this is readily determined simply by enabling the circuit 36 as hereinbefore described and then noting the repetition rate of the interrupted carrier signal via the receiver.

The battery 39 shown in the figures comprises an EVEREADY* E13 (or equivalent) hearing aid type battery. It is rated at 1.4 volts, 85 mAh, and the battery provides a useful service life exceeding 75 hours of continuous operation. Current drain of the circuit 36 is about 2 ma, developing an input power of about 2.8 milliwatts. A field strength of 646 uV/meter was measured at a distance of 3 meters from the circuit 36 operating at a frequency of 143 MHz. This is considered to be a low radiation level which is not expected to require special licensing under a government agency.

*Trade Mark

When fabricated in accordance with the description hereinbefore presented, the portion 13 of the shaft 11 acts as a ¼ wave radiating element of an antenna. Depending upon receiver sensitivity, terrain conditions and the arrow's lay position, the detectable range of the transmitted interrupted carrier signal may exceed 300 meters.

When the arrow 10 is intact, the RF output signal is taken directly from the emitter of the transistor 42 via the antenna 41. It will be observed in FIG. 6 that the emitter is also connected to the negative terminal of the battery 39. Shorting the RF output of the transistor 42 is prevented by means of an RF bead 47 which is placed coaxially about the lead connecting the emitter to the contact 38.

Under normal circumstances, the interrupted carrier signal is capacitively coupled from the antenna 41 to the portion 13 which reradiates the signal energy. In the event that the portion 13 is broken, however, the wire of the antenna 41 itself becomes the primary radiating element to maintain an output signal irrespective of the arrow's physical condition.

It will be apparent to those skilled in the art to whom this specification is addressed that the embodiments heretofore described may be varied to meet particular specialized requirements without departing from the true spirit and scope of the invention disclosed. For example, whereas the shaft 11 is described as having aluminum side walls, an arrow shaft of a non-conductive material such as fiber glass may also be used. In this event, the antenna 41 would be the only radiating element. In this embodiment, however, a positive battery return conductor would have to be provided to substitute for the aluminum side walls. Also, whereas the circuit 36 is shown to comprise a self excited oscillator having an LC tank circuit, the oscillator may be of another form such as a crystal oscillator in which a crystal comprises the tank circuit. The foregoing embodiments are therefore not to be taken as indicative of the limits of the invention but rather as exemplary structures thereof which are described by the claims appended hereto.

The embodiments of the invention in which an exclusive property or privilege is claimed are defined as follows:

1. A trackable arrow, comprising:

a shaft having side walls defining a hollow chamber;

an electrically conductive member coextensive with the shaft and adapted to function as a radiating element of an antenna;

radio signalling means including variable rate carrier interrupt means disposed within the chamber, the interrupt means being rate responsive to a source of operating voltage; and coupling means positioned between an output of the signalling means and the conductive member to effect a transfer of radio signal energy therebetween, whereby interrupted carrier signals radiated from the conductive member are detectable by a directional radio receiver to effect a test of the energy source prior to releasing the arrow from a bow and subsequently tracking and locating the released arrow.

2. An arrow as claimed in claim 1 wherein the side walls further define an elongated cylindrical tube having open tip and butt ends, the arrow further comprising:

a nock fixedly positioned in and closing the open butt end, and a tip insert fixedly positioned in the open tip end for receiving and mounting an arrow tip in coaxial alignment with the shaft.

3. An arrow as claimed in claim 2 wherein the conductive member comprises a wire antenna disposed coaxially within the shaft between the coupling means and butt end and the coupling means comprises an electrical terminal connecting one end of the antenna to the output of the signalling means.

4. An arrow as claimed in claim 2 wherein the side walls are electrically conductive and comprise the electrically conductive member.

5. An arrow as claimed in claim 4 wherein the coupling means comprises:

a wire antenna disposed coaxially within the shaft between the output of the signalling means and the butt end;

an electrical terminal connecting one end of the antenna to the output of the signalling means; and an insulative dielectric disposed between the antenna and the electrically conductive side walls.

6. An arrow as claimed in claim 5 wherein the radio signalling means comprises:

a transmitter;

a battery slidably disposed within the chamber between the transmitter and tip insert and providing a source of operating voltage and current for the transmitter; and switch means operably responsive to the axial position of the arrow tip in the tip insert for selectively connecting and disconnecting the transmitter and battery.

7. An arrow as claimed in claim 6 wherein the tip insert includes a central aperture therethrough with a portion of the aperture being defined by threaded side walls adapted to threadably engage corresponding external threads on a trailing axial extension of the arrow tip.

8. An arrow as claimed in claim 7, further comprising:

insulative spring means positioned between the slidable battery and the fixed transmitter to maintain the battery and transmitter in spaced relation.

9. An arrow as claimed in claim 8 wherein the battery abuts the inserted end of the tip insert and is held yieldingly thereagainst by the spring means and further comprising a pair of electrical contacts extending from the transmitter and held in spaced yielding relation with corresponding contacts on the battery, whereby threadably inserting the axial extension of the arrow tip through the tip insert displaces the battery towards the transmitter to make electrical contact therewith.

10. An arrow as claimed in claim 9 wherein the transmitter includes a local oscillator for generating the interrupted carrier signals at an interruption rate inversely proportional to battery voltage.

11. An arrow as claimed in claim 10 further comprising a compression washer disposed on the axial extension of the arrow tip between a shoulder of the tip and a corresponding annular abutting surface of the tip insert.

12. An arrow as claimed in claim 11 wherein the shaft comprises aluminum side walls which function as a quarter-wave radiating element, the arrow further comprising fletching means uniformly disposed about the external periphery of the shaft and radially outstanding therefrom adjacent the butt end.

13. An arrow as claimed in claim 12 wherein the local oscillator comprises:

a transistor having an emitter, base and collector, the collector being connected to one side of the battery, and the emitter connected to the wire antenna via the electrical terminal;

an electrical conductor connecting the emitter to the other side of the battery;

an RF bead coaxially disposed about the electrical conductor between the emitter and the battery; and timing circuit means connected between the collector and base.

14. An arrow as claimed in claim 13 wherein the timing circuit means comprises a serial combination of an inductor together with a resistor and capacitor connected in parallel relation.

15. An arrow as claimed in claim 14 wherein the local oscillator further comprises a capacitor of small electrical value connected between the emitter and collector.

16. An arrow as claimed in claim 5, further comprising:

a diode electrically connecting the other end of the wire antenna to the electrically conductive side walls of the shaft, the diode being poled to provide a high back resistance to a short circuit current flow between the shaft and an electrically conductive arrow tip threadably engaging the tip insert.

17. An arrow as claimed in claim 16, further comprising an RF bead coaxially disposed about the wire antenna adjacent the diode and wherein the diode provides a low forward resistance to a battery charging current.

18. A method for testing a source of operating voltage used to power a radio signalling transmitter, comprising the steps of:

emitting a continuous carrier signal from the transmitter;

interrupting the signal at a rate inversely proportional to the operating voltage;

receiving and detecting the interrupted carrier signal; and relating the carrier signal interruption rate to a predetermined voltage value.

* * * * *